United States Patent [19]

Brown

[11] B 3,996,431

[45] Dec. 7, 1976

[54] MULTIPLE CIRCUIT SLIDE SELECTOR SWITCH HAVING FIXED CONTACT RETAINING BAND

[75] Inventor: Harry W. Brown, Big Bend, Wis.

[73] Assignee: Cutler-Hammer, Inc., Milwaukee, Wis.

[22] Filed: June 19, 1974

[21] Appl. No.: 480,740

[44] Published under the second Trial Voluntary Protest Program on March 2, 1976 as document No. B 480,740.

[52] U.S. Cl. ..... 200/16 C; 200/284; 200/293

[51] Int. Cl.[2] ..... H01H 15/04

[58] Field of Search ..... 200/16 C, 16 D, 61.54, 200/76, 243, 275, 280, 281, 284, 293–295, 314; 339/210, 213

[56] References Cited

UNITED STATES PATENTS

| | | | |
|---|---|---|---|
| 2,981,897 | 4/1961 | Beggs | 339/210 R X |
| 3,029,320 | 4/1962 | Laete | 200/16 C |
| 3,192,352 | 6/1965 | Piber | 200/314 |
| 3,223,794 | 12/1965 | Hoy et al. | 200/243 X |
| 3,329,778 | 7/1967 | Bedocs | 200/16 C |
| 3,330,930 | 7/1967 | Hill et al. | 200/243 |
| 3,504,140 | 3/1970 | Atkinson | 200/16 C |
| 3,549,832 | 12/1970 | Ferryman, Jr. | 200/61.54 X |
| 3,602,656 | 8/1971 | Graddy et al. | 200/16 C X |
| 3,604,863 | 9/1971 | Schink | 200/16 C |
| 3,691,323 | 9/1972 | Anderson et al. | 200/166 X |

*Primary Examiner*—James R. Scott
*Attorney, Agent, or Firm*—H. R. Rather; Wm. A. Autio; M. E. Taken

[57] ABSTRACT

A multi-position selector switch of the sliding bridging contact type having a molded plastic base and a metal cover closing the open top of the base and also serving to pivot the operating lever. A plurality of similar one-piece stationary contact-terminals are inserted through holes in the bottom of the base and are held in place by a plastic liner that is dropped in to hug the walls of the base and is clamped down by the cover. The stationary contact-terminals have pairs of wings recessed in the bottom of the base whereby they are held in place by the plastic liner. A movable bridging contact is spring-biased on a reciprocal actuator block that is detented to the cover. The inner end of the operating lever extends into a slot in the actuator block whereby the latter is moved over the stationary contacts from one detent to another. The switch parts are designed for simplicity and east of manufacture and automated assembly.

10 Claims, 9 Drawing Figures

Fig. 1
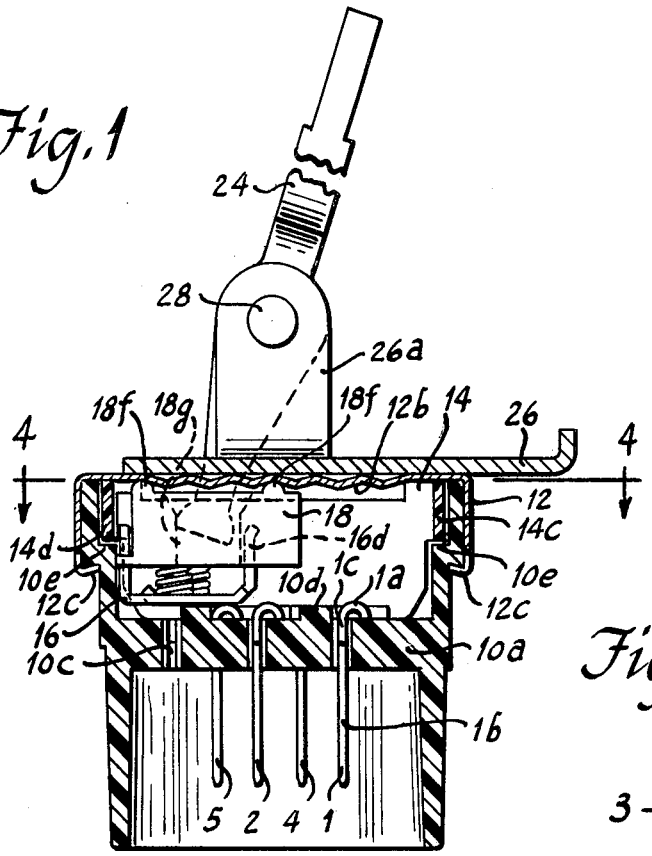
Fig. 2
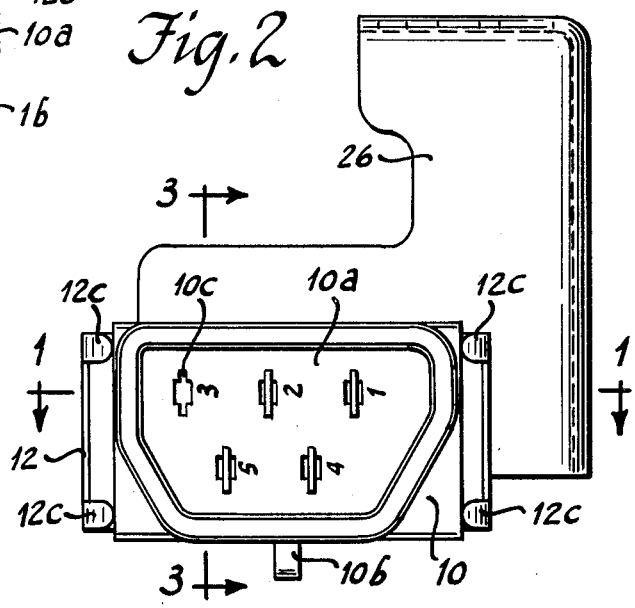
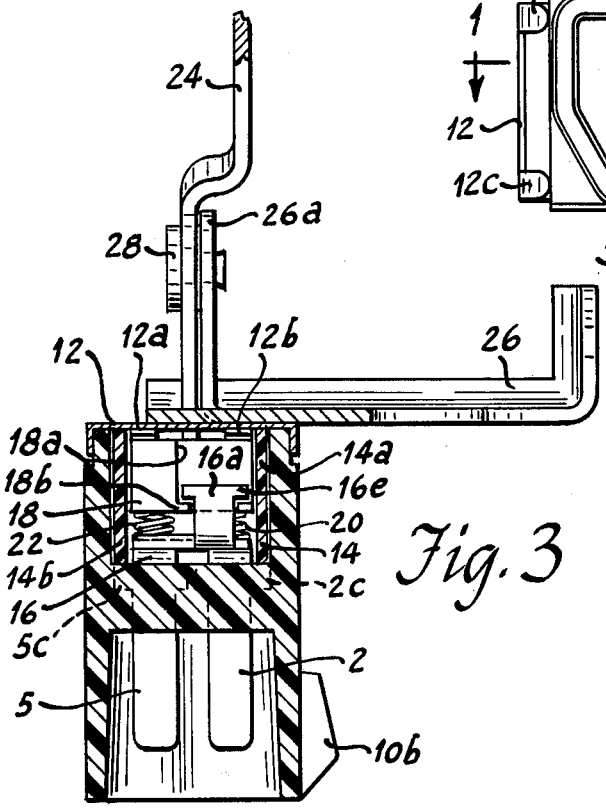
Fig. 3

MULTIPLE CIRCUIT SLIDE SELECTOR SWITCH HAVING FIXED CONTACT RETAINING BAND

BACKGROUND OF THE INVENTION

Multi-position selector switches of the sliding bridging contact type have been known heretofore. However these prior switches have one or more disadvantages in that the stationary contact-terminals were either formed of two parts riveted together across the housing wall, clamped between housing sections, molded as inserts into the housing wall, formed to snap into slots in the housing wall, staked into the housing wall, or the like, thus adding to the cost and difficulty of assembly. Also, the prior designs of bridging contacts encountered certain difficulties in staying in place in the actuator block under the spring bias.

While these prior switches were useful for their intended purpose, this invention relates to improvements thereover.

SUMMARY OF THE INVENTION

This invention relates to multiple circuit selector switches and more particularly to simplified switches especially adapted to ease of manufacture and automated assembly.

An object of the invention is to provide an improved multiple circuit selector switch.

A more specific object of the invention is to provide such selector switch with stationary contact-terminals that can be assembled by inserting them through holes in the bottom of the insulating base.

Another specific object of the invention is to provide such stationary contact-terminals with wings whereby they are held in place by an insulating liner that can be dropped within the switch base.

Another specific object of the invention is to provide such selector switch with an improved bridging contact facilitating assembly thereof onto a slidable actuator block.

Another object of the invention is to provide such switch with simplified parts adapted for automatic assembly.

Other objects and advantages of the invention will hereinafter appear.

BRIEF DESCRIPTION OF THE DRAWINGS

FIG. 1 is an enlarged cross-sectional view of the multiple circuit selector switch taken along line 1—1 of FIG. 2 with the movable contact actuator block in its extreme left-hand position;

FIG. 2 is a bottom view of the switch of FIG. 1;

FIG. 3 is a cross-sectional view taken along line 3—3 of FIG. 2 perpendicular to the view of FIG. 1 with the movable contact actuator block in its extreme right-hand position to show the left end thereof;

Referring to FIGS. 1–3, there is shown a multiplex circuit selector switch constructed in accordance with the invention. This switch is provided with a molded insulating base 10 having an upper compartment for the terminals divided by a horizontal partition 10*a*. This base is substantially rectangular in top view as shown in FIG. 4. The upper compartment of the base is open at the top and adapted to be closed by a metal cover 12. The lower compartment is open at the bottom to provide access for a plug carrying wire terminals that are to be connected to the contact terminals extending thereinto through the partition. This lower compartment is non-symmetrically shaped as shown in FIG. 2 so that a complementary-shaped connector plug (not shown) can be inserted only in the correct way thereinto. A lug 10*b* is provided on the outer wall of the base for retaining such plug.

As shown in FIGS. 1–4, partition 10*a* is provided with two rows of slots 10*c* for accommodating stationary contact-terminals, there being three slots in the front row for contact-terminals 1, 2 and 3 (not used in this version) and two slots in the rear row for contact-terminals 4 and 5 as shown in FIG. 2, staggered with respect to the slots in the front row to afford maximum electrical clearance between the terminals.

As shown in dotted lines in FIG. 3, each of these slots within the partition is generally T-shaped with the stem of the T extending all the way through the partition to allow insertion of the terminal therethrough and the cross of the T extending partway into the partition for supporting the contact.

In the version shown, stationary contact-terminals 1, 2, 4 and 5 have been inserted into the first two slots in the front row and the two slots in the rear row, respectively, with the third slot in the first row left unused.

Figure 4:
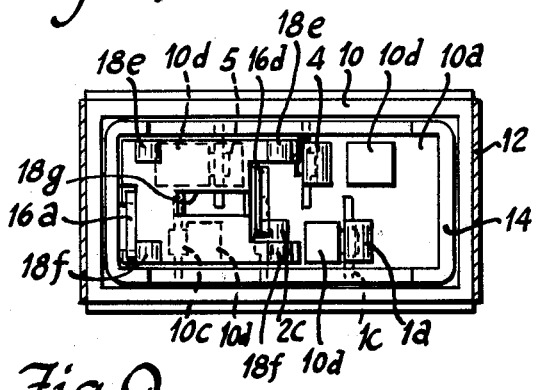
FIG. 4 is a horizontal cross-sectional view taken along line 4—4 of FIG. 1 to show the top of the movable contact actuator block.

Since the stationary contact-terminals are alike, only one will be described in detail. As shown in FIGS. 1, 3 and 4, stationary contact-terminal 1 is generally T-shaped plus a crown 1*a* forming the stationary contact above the partition. Thus, the stem 1*b* of the T extends through the partition as shown in FIG. 1 to form a terminal for attachment of a wire connector. The wings 1*c* on the cross of the T rest in the lateral portions of the slot that extend partway into the partition as shown in FIG. 3. The upper edges of these wings are flush with the upper surface of partition 10*a* and one such wing (5*c*, 2*c* in FIG. 3) of each contact-terminal extends to the front or rear wall of the upper compartment beneath retainer 14 whereby the contact-terminals are held in place without any other securing means. Crown 1*a* is an upstanding continuation of stem 1*b* above the wings 1*c* curved to one side to provide a semi-cylindrical surface for engagement by the movable contact as shown in FIG. 1. These one-piece, formed stationary contact-terminals are made of a good electrically-conducting metal such as copper or the like. These stationary contact-terminals are assembled in the base so that all of these contacts such as 1*a* extend toward the right, as viewed in FIG. 1 and slightly above supports 10*d* integrally molded on the upper surface of partition 10*a* that support the movable contact.

Figure 6:
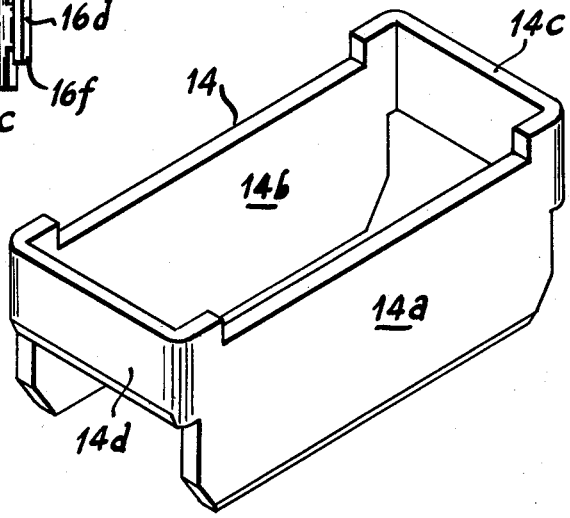
FIG. 6 is an enlarged isometric view of the contact-terminal retainer of FIGS. 1, 3 and 4.

Retainer 14 is a molded plastic member in the form of a liner hugging the walls of the upper compartment. After the stationary contact-terminals have been inserted into their slots, this retainer is dropped into the upper compartment. Its front plate 14*a* and rear plate 14*b* press down on the outer wings (such as 2*c* and 5*c*) of the contact-terminals to hold them in place as shown in FIG. 3. As shown in the isometric view in FIG. 6, these front and rear plates are connected at their ends by end members 14*c* and 14*d* of narrower width. Suitable steps 10*e* are molded within the end walls of the base as shown in FIG. 1 to accommodate these end members 14*c* and 14*d* of the retainer. The lower corners of front and rear plates 14*a* and 14*b* are beveled to facilitate automatic assembly. Thus, when this retainer is dropped into the upper compartment of the base, these beveled corners prevent it from hanging up on one of the steps 10*e* in the end walls of the base but cause it to settle down into the compartment so that the cover can be clamped on top.

Figure 5:
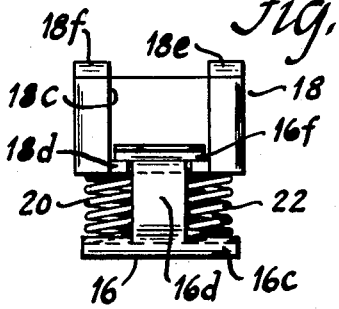
FIG. 5 is a right end view of the movable contact actuator block of FIGS. 1, 3 and 4.
Figure 7:
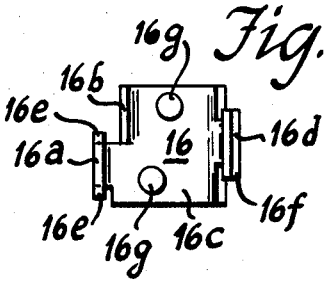
FIG. 7 is a top view of the movable bridging contact of FIGS. 1 and 3.

Movable contact 16 is shown in FIGS. 1, 2, 5 and 7 and consists of a generally U-shaped member of good electrical conducting metal such as copper or the like. As shown in FIGS. 3 and 7, the left upstanding arm 16*a* is offset forwardly to provide room for a notch 16*b* in the rather wide bottom plate 16*c* that slides over the stationary contacts such as 1*a*. The right upstanding arm 16*d* arises from the center of the right edge of the bottom plate as shown in FIGS. 5 and 7.

Left arm 16*a* is provided with a pair of lateral ears 16*e* at its upper end whereby it is retained on actuator block 18 as shown in FIG. 3. For this purpose, the left end of the actuator block is provided with a shallow slot 18*a* having a pair of spaced lugs 18*b* at the lower end thereof on which ears 16*e* rest to retain the movable bridging contact on the actuator block.

Right arm 16*d* of this movable contact is also provided with a pair of lateral ears 6*f*, as shown in FIG. 5, at its upper end whereby it is retained on the actuator block. For this purpose, the right end of the actuator block is provided with a deeper slot 18*c* having a pair of spaced lugs 18*d* at the lower end thereof on which ears 16*f* rest to retain the movable bridging contact on the actuator block. In addition, the upper end of right arm 16*d* is bent at a small angle outwardly as shown in broken lines in FIG. 1 to provide a cam for assembly of the movable bridging contact onto the actuator block. That is, the inner surface of this bent part of the arms forms a cam. To use it, helical springs 20 and 22 are first inserted into their wells in the bottom of the actuator block. Then the ears on the left arm 16*a* are hooked on lugs 18*b* and the right end of the movable bridging contact is swung over and pressed onto the actuator block until ears 16*f* on the right arm snap over lugs 18*d*. In doing this, the aforesaid cam surface on the right arm slides over the associated lugs and thus cams the ears over these lugs to facilitate assembly of the movable bridging contact onto the actuator block. A pair of bosses 16*g* are formed on the movable contact as shown in FIG. 7 to hold the lower ends of springs 20 and 22 in place.

The upper surface of the actuator block is provided near its four corners with two pairs of detent bumps 18*e* and 18*f* for cooperation with two rows of detent recesses 12*a* and 12*b*, respectively, provided by two rows of equally spaced humps formed on the lower surface of cover 12 as shown in FIGS. 1, 3, 4 and 5. The detent bumps on the actuator block are semi-cylindrical shaped so that their rounded surfaces slide over the humps into the recesses there between. The detent bumps of each pair are spaced a distance equal to a multiple of the spacing between recesses so that both bumps of both pairs will engage and stop in recesses at the same time to positiion the movable contact. Helical springs 20 and 22 are in compression between the movable bridging contact and the actuator block and thereby bias bumps 18*e* and 18*f* against recesses 12*a* and 12*b* in the bottom surface of the cover. This resilient spring pressure allows the bumps on the actuator block to climb over the humps on the cover and enter the recesses for detenting of the switch. A rectangular slot 18*g* extends vertically through the actuator block as shown in FIG. 4 for receiving the lower end of operating lever 24 as shown in FIG. 1.

Cover 12 is a generally rectangular steel plate formed into an inverted U-shaped so that it will cover and embrace the switch base. The cover also has tabs 12*c* at the corners of its depending ends so that they can be bent over to grip the undercut overhangs provided on the opposite ends of the base as shown in FIGS. 1 and 2.

A mounting bracket 26 is rigidly secured to the cover as by riveting or the like. The mounting bracket is suitably formed and provided with holes to adapt it for mounting the switch as desired.

This bracket is provided with means for pivotally supporting operating lever 24. This means comprises an upstanding tab 26*a* shown in FIG. 1 that is bent up from the bracket. This tab has a pivot pin 28 secured thereto for pivoting operating lever 24 at its intermediate point so that it can be swung in opposite pivotal directions to slide actuator block 18 and the movable bridging contact carried by the latter alternately to the left and right as seen in FIG. 1 for selective bridging of the stationary contacts.

Figure 8:
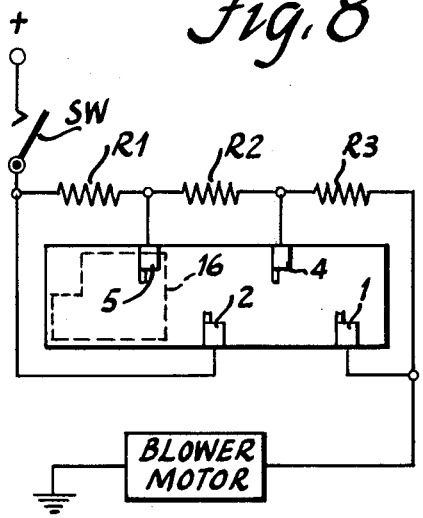
FIG. 8 is a circuit diagram showing an exemplary use of the four terminal switch of FIGS. 1–7.

FIG. 8 shows a circuit diagram of an exemplary application of the switch illustrated and described. As shown therein, the positive side of a D.C. source is connected through an on-off switch SW, speed control resistors R1, R2 and R3 in a series and then through a blower motor of an auto air conditioner to the other side of the D.C. source at ground potential. The junction between resistors R1 and R2 is connected to terminal 5 of the switch, the juntion between resistor R2 and R3 is connected to terminal 4, the junction between resistor R3 and the blower motor is connected to terminal 1, and the positive side of the D.C. source is also connected through switch SW to terminal 2. The outline of movable bridging contact 16 is shown in dotted lines.

After closing on-off switch SW, with the selector switch in the position shown in FIG. 1, the movable contact engages only stationary contact 5 as shown in FIG. 8. This is the "off" or open position of the switch wherein the blower motor runs at low speed. In this position, cuurrent flows through switch SW, resistors R1, R2 and R3 and the blower motor. With all three resistors in circuit, the blower runs at low speed.

When the selector switch is operated to the first detent, contacts 5 and 2 are bridged by movable contact 16. This shunts out resistor R1 to increase the current, and thus the power, applied to the motor. As a result, the motor runs at a first medium speed.

When the selector switch is operated to the next detent, contacts 2 and 4 are bridged by movable contact 16. This shunts out resistors R1 and R2 to increase the power applied to the motor. As a result, the motor now runs at the higher of two medium speeds.

When the selector switch is operated to the third, and last, detent, contacts 2, 4 and 1 are bridged by the movable contact. Contacts 2 and 1 and the movable contact shunt all three resistors and place the blower motor directly across the D.C. source to increase the power applied to the motor. As a result, the motor now runs at its high speed.

Figure 9:
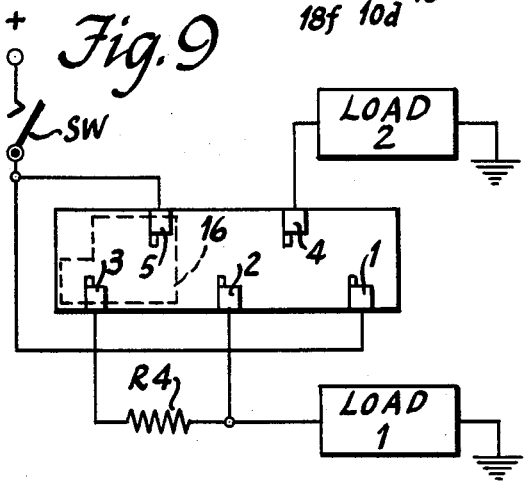
FIG. 9 is a circuit diagram showing an exemplary use of a five terminal switch wherein a fifth stationary contact-terminal is added in the vacant slot in the base.

FIG. 9 shows a circuit diagram of an exemplary application of the switch when a fifth stationary contact-terminal is added in the vacant slot in the base. The positive side of a D.C. source is connected through an on-off switch, which may be operated coincident with the ignition switch of an automobile, to terminal 5 and 1. Terminal 3 is connected through resistor R4 and LOAD 1 to the other side of the D.C. source at ground potential whereas the junction between resistor R4 and this load is connected to terminal 2. Terminal 4 is connected through LOAD 2 to ground.

After closing on-off switch SW, with the selector switch in the position shown by dotted line movable bridging contact 16, LOAD 1 is connected in series with resistor R4 across the D.C. source. This affords low speed operation if this load is a blower motor as in FIG. 8.

When the selector switch is operated to the first detent, contacts 5 and 2 are bridged by movable contact 16 to shunt resistor R4 for high speed operation of LOAD 1.

The selector switch is then operated through the second detent to the third and last detent wherein contacts 4 and 1 are bridged. As a result, LOAD 1 becomes deenergized and LOAD 2 becomes energized through the on-off switch across the D.C. source.

While two uses of the selector switch have been shown, it will be apparent that other combinations of terminals, circuits and loads are possible.

While the apparatus hereinbefore described is effectively adapted to fulfill the objects stated, it is to be understood that the invention is not intended to be confined to the particular preferred embodiments of multiple circuit selector switches disclosed, inasmuch as they are susceptible of various modification without departing from the scope of the appended claims.

I claim:

1. A multiple circuit selector switch having a plurality of operating positions for energizing corresponding electric circuits comprising:

a switch housing including an insulating base and a cover forming a compartment for the switch contacts and a plurality of slots in the bottom of said base, each said slot having a through-portions extending all the way through the bottom of said base and a partial-portion extending partway down into the bottom of said base near an adjacent wall of said base;

a plurality of formed, one-piece stationary contact-terminals in said slots having terminals extending out through said through-portions in the bottom of said base and having wings in said partial-portions of the slots extending toward adjacent walls of said base and having stationary contacts within said compartment;

an insulating retainer lining walls of said compartment, being held down by said cover and having lower portion over said wings for retaining said stationary contact-terminals fixed in their slots;

a contact actuator block reciprocally movable in said compartment;

a spring-biased movable bridging contact carried by said actuator block for engaging said stationary contacts selectively;

operating means for actuating said actuator block;

and mounting means on said housing for mounting said switch to a support.

2. The multiple circuit selector switch defined in claim 1, wherein said insulating retainer comprises:

a plastic member hugging the vertical walls around said compartment and having front and rear portions whose lower edges press down on the wings of said stationary contact-terminals to hold them down in their slots.

3. The multiple circuit selector switch defined in claim 1, wherein said insulating retainer comprises:

a plastic liner lining the vertical walls of said compartment and having side plates held down by said cover and pressing down on the wings of said stationary contact-terminals to hold the latter in their slots.

4. The multiple circuit selector switch defined in claim 1, wherein each said stationary contact-terminal comprises:

a generally T-shaped member of good electricity conducting metal having its wings in its slot flush with the bottom of said compartment, its stem extending out through its slot to provide a terminal for connection to an external circuit, and having a contact extending from between said wings above the bottom of said compartment.

5. The multiple circuit selector switch defined in claim 4, wherein:

said contact is an upper extension opposite said stem formed into a curved form for engagement by said movable bridging contact.

6. The multiple circuit selector switch defined in claim 1, wherein:

said spring-biased movable bridging contact comprises a generally U-shaped member of good electrically conducting metal having a pair of ears on each of its upstanding arms and one arm having a small-angle outward bend at its upper end to provide a cam surface;

and said actuator block comprises a pair of spaced lugs at one end onto which the ears of one said arms are hooked and a pair of spaced lugs at the other end over which the ears of the bent arm are snapped to attach said movable bridging contact to said actuator block;

and compression spring means biasing the intermediate portion of said movable bridging contact away from said actuator block.

7. The multiple circuit selector switch defined in claim 6, wherein:

said actuator block comprises clearance above its pairs of lugs to allow compression of said movable bridging contact toward said actuator block against said spring means.

8. The multiple circuit selector switch defined in claim 6, wherein:

said actuator block comprises a slot at each end in which the respective pairs of lugs are located to accommodate the arms of said movable bridging contact within the external dimensions of said actuator block.

9. The multiple circuit selector switch defined in claim 1, wherein:

said actuator block and said cover comprises detent means defining a plurality of operating positions wherein said movable bridging contact is in engagement with selected stationary contacts.

10. The multiple circuit selector switch defined in claim 1, wherein:

said operating handle comprises a toggle lever pivotally supported on said mounting means and having an end in engagement with said actuator block for moving the latter.

* * * * *